US007864977B2

(12) United States Patent
Sadaie et al.

(10) Patent No.: US 7,864,977 B2
(45) Date of Patent: Jan. 4, 2011

(54) VOICE COIL ASSEMBLY AND LOUDSPEAKER USING THE SAME

(75) Inventors: Koichi Sadaie, Neyagawa (JP); Yoshihide Toyoshima, Neyagawa (JP); Hiroyasu Kumo, Neyagawa (JP)

(73) Assignee: Onkyo Corporation, Neyagawa-shi (JP)

( * ) Notice: Subject to any disclaimer, the term of this patent is extended or adjusted under 35 U.S.C. 154(b) by 0 days.

(21) Appl. No.: 12/696,205

(22) Filed: Jan. 29, 2010

(65) Prior Publication Data

US 2010/0215208 A1 Aug. 26, 2010

(30) Foreign Application Priority Data

Feb. 24, 2009 (JP) ..... 2009-040679
Nov. 4, 2009 (JP) ..... 2009-253063

(51) Int. Cl.
*H04R 1/00* (2006.01)
*H04R 9/06* (2006.01)
*H04R 11/02* (2006.01)

(52) U.S. Cl. ..... 381/407; 381/396; 381/400; 381/401; 381/423; 381/431

(58) Field of Classification Search ..... 381/407
See application file for complete search history.

(56) References Cited

U.S. PATENT DOCUMENTS 5,664,024 A * 9/1997 Furuta et al. ..... 381/412

FOREIGN PATENT DOCUMENTS

JP 55-88590 U 6/1980
JP 57-099898 A 6/1982
JP 63-299500 12/1988
JP 07-131890 5/1995

* cited by examiner

*Primary Examiner*—Curtis Kuntz
*Assistant Examiner*—Matthew Eason
(74) *Attorney, Agent, or Firm*—Renner, Otto, Boisselle & Sklar, LLP

(57) ABSTRACT

According to the invention, a whole-surface driven, flat thin loudspeaker that brings about smooth frequency characteristics with split vibration hardly caused is realized, and a voice coil assembly that has high reproduction efficiency and fewer operation failures, and brings about favorable work efficiency in manufacturing and further reduced manufacturing cost, and a loudspeaker using the same are manufactured. The voice coil assembly includes a rectangular voice coil including a rectangular bobbin formed with a rectangular cross section and a rectangular coil bonded to the rectangular bobbin, and a rectangular reinforcing member coupling the plurality of rectangular voice coils to one another in a grid pattern, wherein a portion of inner wall surfaces of the rectangular reinforcing member is bonded to any of outer wall surfaces of the rectangular bobbins of the plurality of rectangular voice coils, and the outer wall surfaces of the rectangular bobbins, to which the inner wall surfaces of the rectangular reinforcing member are not bonded, and portions of the inner wall surfaces of the rectangular reinforcing member, which are not bonded to the outer wall surfaces of the rectangular bobbins define a rectangular space between a pair of the adjacent rectangular voice coils.

14 Claims, 8 Drawing Sheets

VOICE COIL ASSEMBLY AND LOUDSPEAKER USING THE SAME

BACKGROUND OF THE INVENTION

1. Field of the Invention

The present invention relates to a loudspeaker having a magnetic circuits including a plurality of magnets, a voice coil assembly including a plurality of rectangular coils, and a loudspeaker diaphragm to which this voice coil assembly is joined, and the voice coil assembly making up the loudspeaker, and particularly relates to a whole-surface driven, flat thin loudspeaker.

2. Description of the Related Art

Among electrodynamic loudspeakers that convert an audio signal to audio, there is a loudspeaker that employs a plane-type diaphragm as a loudspeaker diaphragm in order to reduce an overall height including magnetic circuits. Although in the plane-type diaphragm, the overall height thereof is lower than that of a cone-type diaphragm, rigidity is insufficient for integral vibration without split vibration. There is a loudspeaker in which bobbins fixed to the plane-type diaphragm have a plurality of voice coils, so that the plane-type diaphragm is vibrated by the plurality of voice coils, thereby suppressing the split vibration. In the related art, as the flat thin loudspeaker having a small overall height, a loudspeaker having a flat diaphragm including a plurality of coils and a magnetic circuit using a plurality of magnets corresponding to the respective coils may be used.

For example, there is a loudspeaker having a thin structure in a drive method of setting many drive points to be close to whole-surface drive, and performing piston movement from a low frequency to a high frequency (Japanese Patent Application Laid-Open No. S57-99898). This loudspeaker has a magnetic circuit group in which a plurality of magnetic circuit units each having at least a pair of two parallel magnetic gaps are arranged in a checkered shape so that the gaps are aligned in parallel in one direction, and one rectangular voice coil is inserted in each of the magnetic circuit units to drive the flat diaphragm.

Moreover, there is a plate-type loudspeaker, in which voice coils are each formed into a square, and the plurality of square voice coils are joined at longitudinal sides and lateral sides to form an aggregate, and this aggregate is attached to a plate diaphragm so that this voice coil aggregate is driven by magnetic circuits (Japanese Utility Model Application Laid-Open No. S55-88590). As shown in FIG. 3 of JP-U No. S55-88590, in this loudspeaker, the plurality of magnetic circuits constructed such that a magnet is sandwiched between one-long-side portions of a pair of belt-like yokes are included, and the numerous magnetic circuits are arranged so that one-side portions of the respective voice coils are inserted between the long-side portions on the other side of the belt-like yokes of these magnetic circuits. In JP-U No. S55-88590, it is described that as to the voice coil aggregate, a coil is wound around a frame body portion to form the voice coil into a square, and then, the plurality of coils are joined at the longitudinal and lateral sides to make up the aggregate.

However, as far as the voice coil aggregate is shown in FIG. 2 of JP-U No. S55-88590, in this voice coil aggregate in the related art, each of the voice coils is wound around an exterior of the frame portion corresponding to a bobbin, and thus, although the adjacent voice coils are joined, the adjacent bobbins making up the voice coil aggregate are spaced by a thickness of linear diameters of the voice coils wound around the exterior, which disables the bobbins to stick together. Furthermore, there is a problem that when the rigidity of the bobbins is insufficient, the bobbins vibrate, resulting in split vibration or that the adjacent bobbins come into contact with each other, thereby causing abnormal noise. Furthermore, in order to solve the problem, an additional heavy substance such as an adhesive to join the adjacent bobbins is needed. As a result, there is a problem that the loudspeaker diaphragm becomes heavier, thereby decreasing reproduction efficiency of the loudspeaker.

Moreover, there is a flat loudspeaker including a bobbin formed of a thin plastic plate by vacuum molding, in which a coil is inserted into a slit of the bobbin (Japanese Patent Application Laid-Open No. S63-299500). Since the coil is arranged in a site of a highest magnetic flux density, that is, a magnetic gap of the magnetic circuit, efficiency of the flat loudspeaker can be increased. In Embodiment 3 shown in FIG. 9 of JP-A S63-299500, there is also disclosed a configuration in which the bobbin is divided into two. In the flat thin loudspeaker having a small overall height, in forming the bobbins to arrange the plurality of coils in the magnetic gaps, a configuration allowing the bobbins to be lightweight and rigid is needed for favorite audio reproduction.

Moreover, as to a damper vibratably holding a voice coil of a loudspeaker, there is disclosed a damper using conductive and elastic phosphor bronze or the like (Japanese Patent Application Laid-Open No. H7-131890). For example, in Embodiment 4 shown in FIG. 5 of JP-A No. H7-131890, loudspeaker dampers 41 are formed by being divided into two using phosphor bronze of a thickness of about 0.1 to 0.5 mm. The use of these loudspeaker dampers 41 can eliminate lead wires that supply audio signals to the voice coils.

The present invention is achieved to solve the problems that the above-described related art has, and an object of the present invention is to realize a whole-surface driven, flat thin loudspeaker that can bring about smooth frequency characteristics with split vibration hardly caused, and, and to manufacture a voice coil assembly that has high reproduction efficiency and fewer operation failures, and further brings about favorite work efficiency in manufacturing and reduced manufacturing cost, and a loudspeaker using the same.

SUMMARY OF THE INVENTION

A voice coil assembly of the present invention is a voice coil assembly comprising a rectangular voice coil including a rectangular bobbin formed with a rectangular cross section and a rectangular coil bonded to the rectangular bobbin, and a rectangular reinforcing member coupling the plurality of rectangular voice coils to one another in a grid pattern, wherein a portion of inner wall surfaces of the rectangular reinforcing member is bonded to any of outer wall surfaces of each of the rectangular bobbins of the plurality of rectangular voice coils, and the outer wall surfaces of the rectangular bobbins to which the inner wall surfaces of the rectangular reinforcing member are not bonded, and portions of the inner wall surfaces of the rectangular reinforcing member, which are not bonded to the outer wall surfaces of the rectangular bobbins define a rectangular space between a pair of the adjacent rectangular voice coils.

Preferably, the voice coil assembly further comprising a reinforcing rectangular bobbin formed with a rectangular cross section, wherein outer wall surfaces of the reinforcing rectangular bobbin are bonded to portions of the inner wall surfaces of the rectangular reinforcing member, and the outer wall surfaces of the rectangular bobbins, to which the inner wall surfaces of the rectangular reinforcing member of the pair of adjacent rectangular voice coils in the grid pattern are not bonded, so that the reinforcing rectangular bobbin defines the rectangular space.

More preferably, the voice coil assembly wherein the rectangular bobbin, the rectangular reinforcing member or the reinforcing rectangular bobbin is formed of any material of a paper material of craft paper or spiral paper, a resin material of Kapton, Silter or Til, or a metal material including aluminum or titanium.

More preferably, the voice coil assembly wherein the rectangular coil is an outer-winding rectangular coil fixed to the outer wall surfaces of the rectangular bobbin.

Preferably, the voice coil assembly wherein the rectangular coil is an inner-winding coil fixed to inner wall surfaces of the rectangular bobbin.

More preferably, the voice coil assembly further comprising a conductive reinforcing member formed of metal foil, wherein the conductive reinforcing member is fixed to a portion that is the outer wall surface of the rectangular reinforcing member and corresponds to border portions between the rectangular voice coils and the rectangular space.

Preferably, the voice coil assembly wherein the conductive reinforcing member has an overall length larger than that of one side of the rectangular space defined between the pair of adjacent rectangular voice coils.

More preferably, the voice coil assembly wherein one end of a lead wire of each of the rectangular voice coils is conductively connected to the conductive reinforcing member, so that the conductive reinforcing member connects the plurality of rectangular voice coils in series or in parallel.

More preferably, the voice coil assembly wherein the conductive reinforcing member further comprises a damper movable portion integrally extended from a strip base body and a damper fixing portion extended from the damper movable portion.

A loudspeaker of the present invention is a loudspeaker, comprising the voice coil assembly, magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, and a frame to which an outer peripheral end of the edge and the magnetic circuits are joined, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps.

Preferably, a loudspeaker comprising the voice coil assembly including the plurality of conductive reinforcing members, magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, a frame to which an outer peripheral end of the edge and the magnetic circuits are joined, and a loudspeaker terminal provided in the frame, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps, and the conductive reinforcing members of the voice coil assembly are conductively connected to the loudspeaker terminal through connection wires or tinsel wires.

More preferably, the loudspeaker further comprising a damper that joins the rectangular reinforcing member or the reinforcing rectangular bobbin defining the rectangular space of the voice coil assembly to the magnetic circuits or the frame to vibratably support the voice coil assembly.

A loudspeaker of the present invention is a loudspeaker, comprising the voice coil assembly including the plurality of conductive reinforcing members, magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, and a frame to which an outer peripheral end of the edge and the magnetic circuits are joined, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps, and the damper fixing portions of the conductive reinforcing members of the voice coil assembly are joined to the frame or the magnetic circuits.

Preferably, the loudspeaker, further comprising a loudspeaker terminal provided in the frame, wherein the damper fixing portions of the conductive reinforcing members of the voice coil assembly are joined to the frame or the magnetic circuits to be conductively connected to the loudspeaker terminal through connection wires.

Hereinafter, the operation of the present invention is described.

The voice coil assembly of the present invention includes a rectangular voice coil including a rectangular bobbin formed with a rectangular cross section and a rectangular coil bonded to the rectangular bobbin, and a rectangular reinforcing member coupling the plurality of rectangular voice coils to one another in a grid pattern. Moreover, the loudspeaker using this voice coil assembly is a whole-surface driven, flat thin loudspeaker, and includes magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, and a frame to which an outer peripheral end of the edge and the magnetic circuits are joined. Accordingly, the voice coil assembly is attached so as to cover almost the whole back surface side of the loudspeaker diaphragm, which allows the whole surface drive to be realized.

In this voice coil assembly, a portion of inner wall surfaces of the rectangular reinforcing member is bonded to any of outer wall surfaces of each of the rectangular bobbins of the plurality of rectangular voice coils, and the outer wall surfaces of the rectangular bobbins to which the inner wall surfaces of the rectangular reinforcing member are not bonded, and portions of the inner wall surfaces of the rectangular reinforcing member, which are not bonded to the outer wall surfaces of the rectangular bobbins define a rectangular space between a pair of the adjacent rectangular voice coils. Alternatively, the voice coil assembly further includes a reinforcing rectangular bobbin formed with a rectangular cross section, and outer wall surfaces of the reinforcing rectangular bobbin are bonded to portions of the inner wall surfaces of the rectangular reinforcing member and the outer wall surfaces of the rectangular bobbins to which the inner wall surfaces of the rectangular reinforcing member of the pair of adjacent rectangular voice coils in the grid pattern are not bonded, so that the reinforcing rectangular bobbin defines the rectangular space.

Namely, in the voice coil assembly of the present invention, the rectangular space constructed by the rectangular bobbins and the rectangular reinforcing member or the reinforcing rectangular bobbin is provided between the pair of adjacent rectangular voice coils to couple the rectangular voice coils apart from one another in the substantial grid pattern. Since the rectangular reinforcing member or the reinforcing rectangular bobbin, specifically, is formed of any material of a paper material of craft paper or spiral paper, a resin material of Kapton, Silter, or Til, or a metal material including aluminum or titanium, the voice coil assembly can ensure sufficient strength to drive the whole-surface of the loudspeaker diaphragm without employing a structure in which the rectangular voice coils stick to one another.

As a result, in this voice coil assembly, since even when the number of rectangular coils is made smaller than that in the related art, the whole surface of the loudspeaker diaphragm having the same area can be driven, the whole-surface driven, flat thin loudspeaker can be realized, in which the weight of the voice coil assembly is reduced, reproduction efficiency of the loudspeaker is high, and flat frequency characteristics with split vibration hardly caused are brought about. Since the rectangular reinforcing member and the reinforcing rectangular bobbin bonded to the outer wall surfaces of the rectangular bobbins are not sandwiched and held by the loudspeaker diaphragm, thickness of the loudspeaker can be reduced, and the drive force of the plurality of the voice coils of the voice coil assembly is advantageously transmitted directly to the loudspeaker. Moreover, since for the rectangular reinforcing member or the reinforcing rectangular bobbin, the same material as that of the rectangular bobbins can be used, manufacturing cost of the voice coil assembly can be reduced.

In the loudspeaker of the present invention, the magnetic circuits having magnetic gaps in which the rectangular coils of the voice coil assembly are arranged include a plurality of magnets capped by rectangular flat plates, and yokes bonded to the magnets, so that the rectangular magnetic gaps are formed between the plates and the yokes. Corresponding to the above-described voice coil assembly, each of the yokes of the magnetic circuits has, at corner portions of the rectangular magnetic gap, insertion grooves through which the rectangular reinforcing member of the voice coil assembly is to be arranged. Accordingly, the voice coil assembly does not come into contact with the magnetic circuits, which can reduce operation failures, and bring about reduction in thickness.

Furthermore, in the case where the loudspeaker of the present invention includes a damper vibratably supporting the voice coil assembly, the rectangular space of the voice coil assembly may be used, and the damper can join the rectangular reinforcing member or the reinforcing rectangular bobbin to the magnetic circuits or the frame. As a result, reduction in thickness of the loudspeaker can be achieved.

Furthermore, the voice coil assembly of the present invention may further include a conductive reinforcing member formed of metal foil. Since in the conductive reinforcing member, a strip base body thereof is fixed to a portion that is the outer wall surface of the rectangular reinforcing member and corresponds to border portions between the rectangular voice coils and the rectangular space, so that the conductive reinforcing member reinforces the border portions between the rectangular voice coils and the rectangular space. When the strip base body of the conductive reinforcing member has an overall length larger than one side of the rectangular space defined between the pair of adjacent rectangular voice coils, at least the two border portions between the rectangular voice coils and the rectangular space are reinforced, and thus, the strength of the voice coil assembly that drives the whole surface of the loudspeaker diaphragm can be further increased.

In the voice coil assembly including this conductive reinforcing member, one end of a lead wire of each of the rectangular voice coils is conductively connected to the conductive reinforcing member, and as a result, the conductive reinforcing member can connect the plurality of rectangular voice coils in series or in parallel, and the manufacturing process of the voice coil assembly can be simplified. The conductive reinforcing member of the voice coil assembly may be conductively connected to a loudspeaker terminal provided in the frame, through a connection wire or a tinsel wire.

Moreover, for example, when being formed of metal foil of phosphor bronze or the like, this conductive reinforcing member may further include a damper movable portion integrally extended from the strip base body and a damper fixing portion extended from the support movable portion. In the loudspeaker including the voice coil assembly having the conductive reinforcing member with the damper integrally formed, the conductive damper portion can be used in place of the connection wire or the tinsel wire to conduct the loudspeaker terminal provided in the frame to the rectangular voice coils. By omitting the connection wires or the tinsel wires, further reduction in thickness of the loudspeaker can be achieved.

Moreover, each of the rectangular coils included in the voice coil assembly may be an outer-winding rectangular coil fixed to the outer wall surfaces of the rectangular bobbin, or may be an inner-winding coil fixed to inner wall surfaces of the rectangular bobbin. In the case of the outer-winding rectangular coil, since manufacturing of the rectangular voice coil is easier, the manufacturing cost of the voice coil assembly can be reduced. In the case of the inner-winding rectangular coil, since an area of the bonding surfaces between the rectangular bobbin to which the inner-winding rectangular coil is bonded, and the rectangular reinforcing member or the reinforcing rectangular bobbin can be made larger than that in the outer-winding coil, the strength of the voice coil assembly can be further increased.

The loudspeaker including the voice coil assembly of the present invention can realize a flat thin loudspeaker that brings about smooth frequency characteristics with split vibration hardly caused, and also higher reproduction efficiency and less operation failures, and favorable working efficiency in manufacturing, and reduction in manufacturing cost can be achieved.

BRIEF DESCRIPTION OF THE DRAWINGS

FIG. 11 is an exploded view for explaining another voice coil assembly of the present invention (Embodiment 4).

DETAILED DESCRIPTION OF THE PREFERRED EMBODIMENTS

Figure 1A:
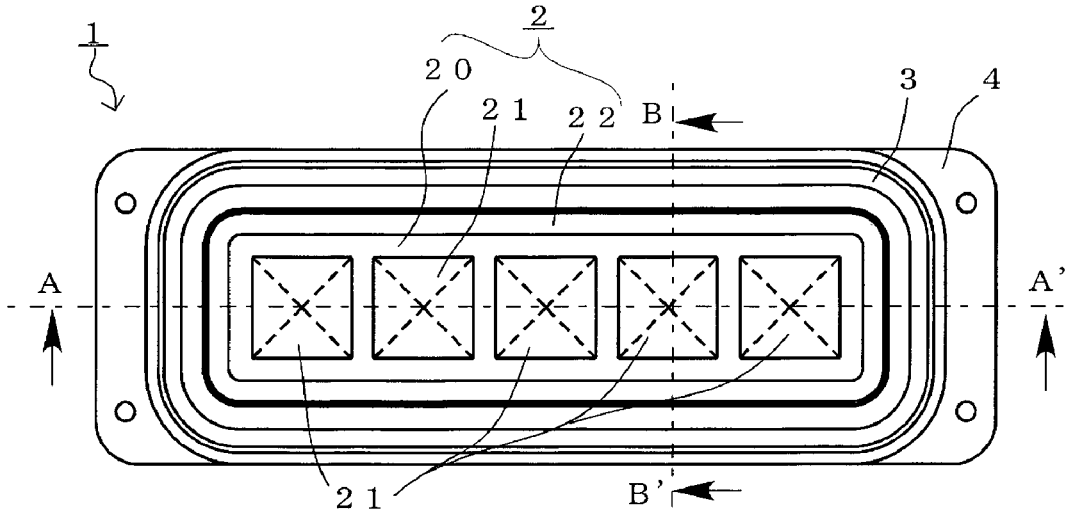
FIGS. 1A to 1C are a plain view and cross-sectional views for explaining a loudspeaker of the present invention (Embodiment 1).

Hereinafter, while referring to the drawings, preferred embodiments of the present invention are specifically described, the present invention is not limited to these embodiments.

Embodiment 1

Figure 1B:
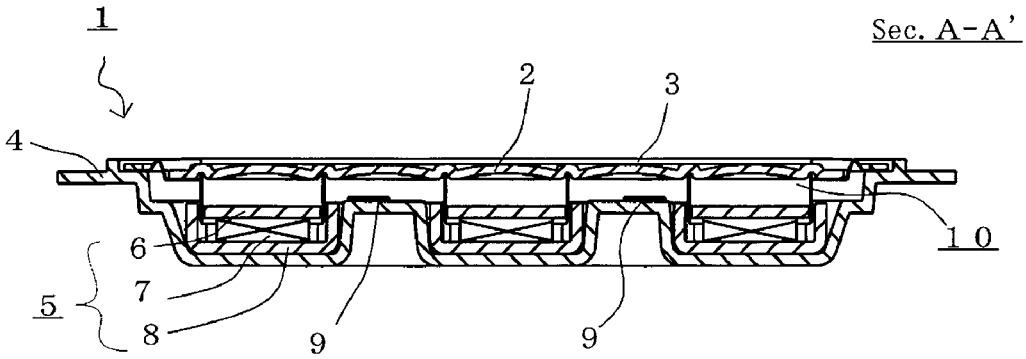
Figure 1C:
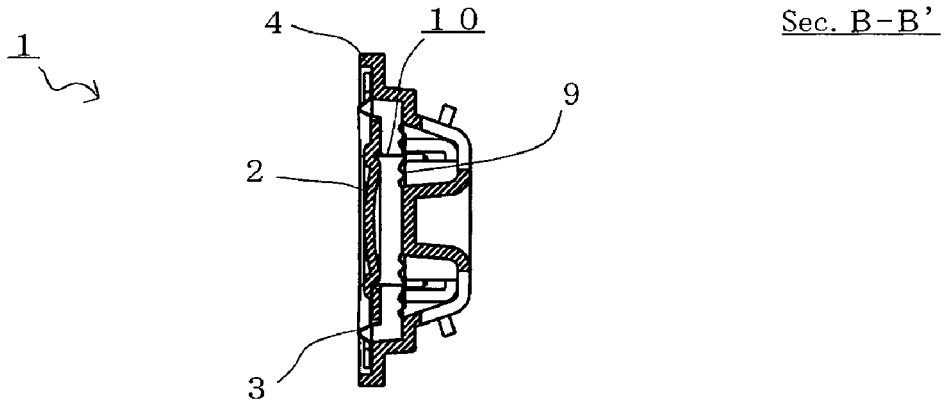
Figure 2:
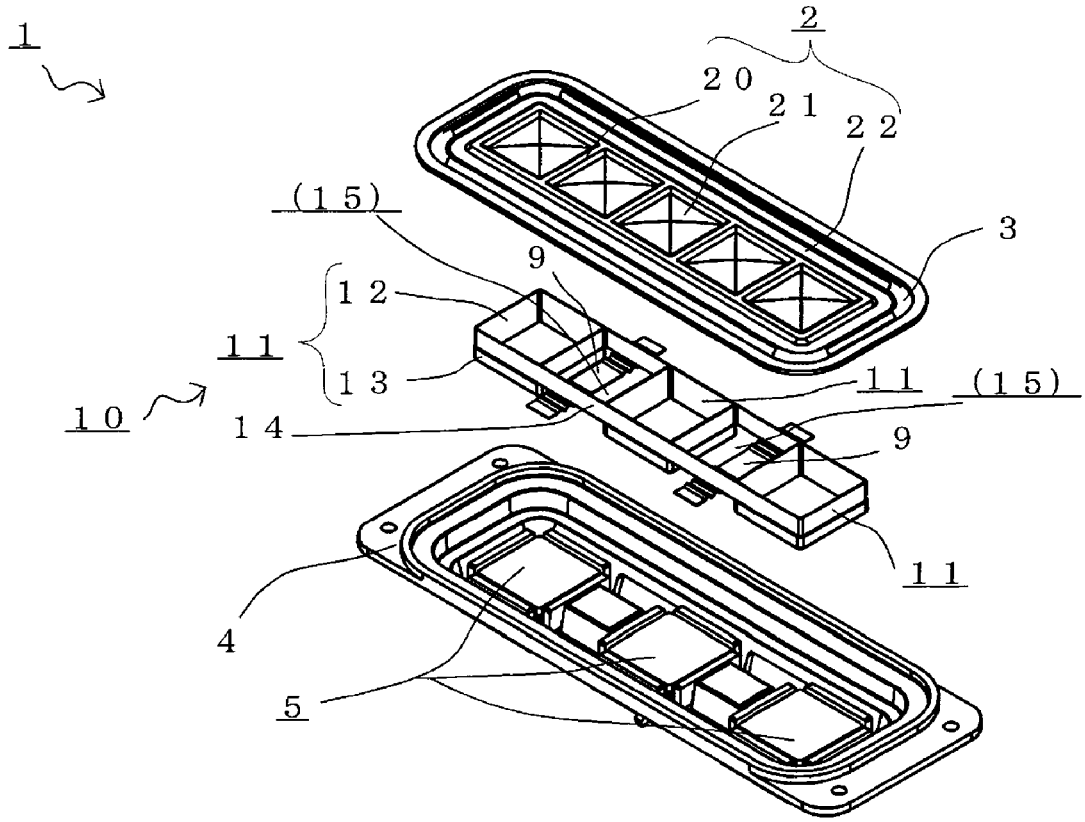
FIG. 2 is an exploded view for explaining the loudspeaker of the present invention (Embodiment 1).
Figure 1:
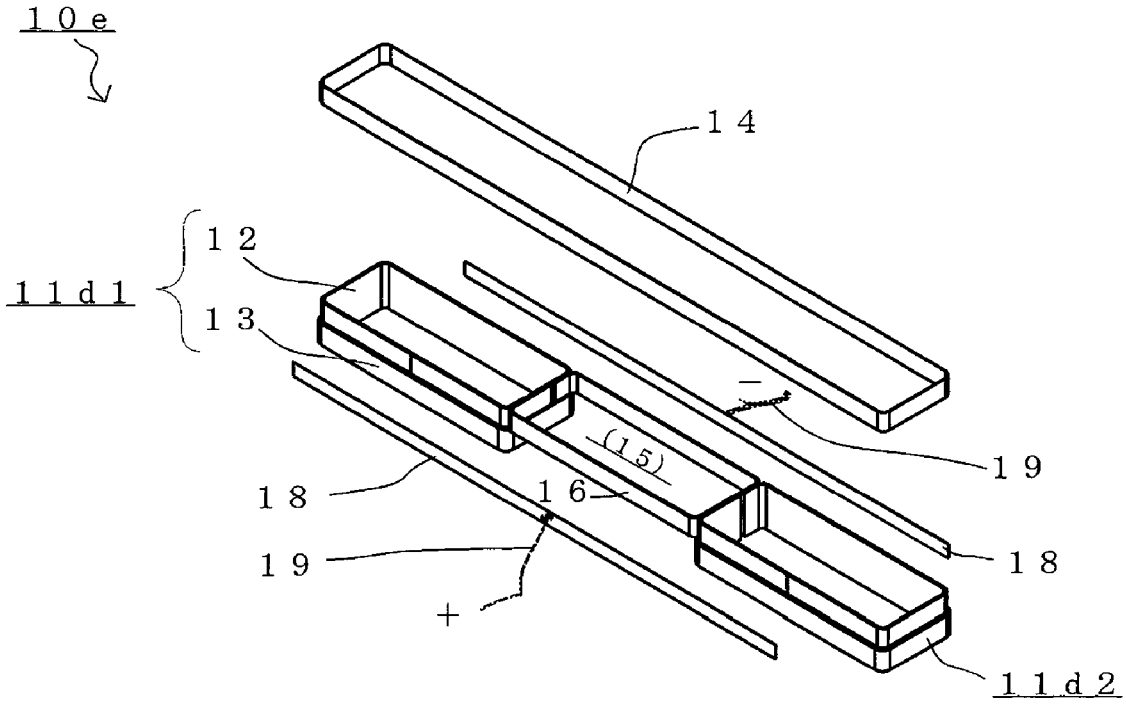

FIGS. 1A to 2 are views for explaining a loudspeaker 1 according to a preferred embodiment of the present invention. Specifically, FIG. 1A is a front-elevational view of the loudspeaker 1, FIG. 1B is a cross-sectional view of an A-A' cross section, and FIG. 1C is a cross-sectional view of a B-B' cross section. FIG. 2 is an exploded view for explaining a configuration of the loudspeaker 1, and a perspective view excluding some components unnecessary for explanation. The loudspeaker 1 has a rectangular flat diaphragm 2, a voice coil assembly 10, a frame 4, and a plurality of magnetic circuits 5 each including a magnet to realize a whole-surface driven, flat thin loudspeaker.

The flat diaphragm 2 of the present embodiment is a planar loudspeaker diaphragm having external dimensions of about 115 mm×30 mm and formed of expanded PP (polypropylene) with a thickness of 1.5 mm. An outer-peripheral end portion thereof is freely supported vibratably by an edge 3. An outer-peripheral end portion of the edge 3 having a roll cross section is fixed to the frame 4 joining the three magnetic circuits 5. The frame 4 is a member having a substantially concave cross section, and formed so as to cover the magnetic circuits 5 from a back surface side thereof, and may be made of a magnetic material such as iron or may be made of a nonmagnetic material such as aluminum and resin. Moreover, the voice coil assembly 10 is joined on the side of the magnetic circuits 5, which is the back surface side of the flat diaphragm 2. The voice coil assembly 10 is freely supported vibratably by two dampers 9.

Figure 3:
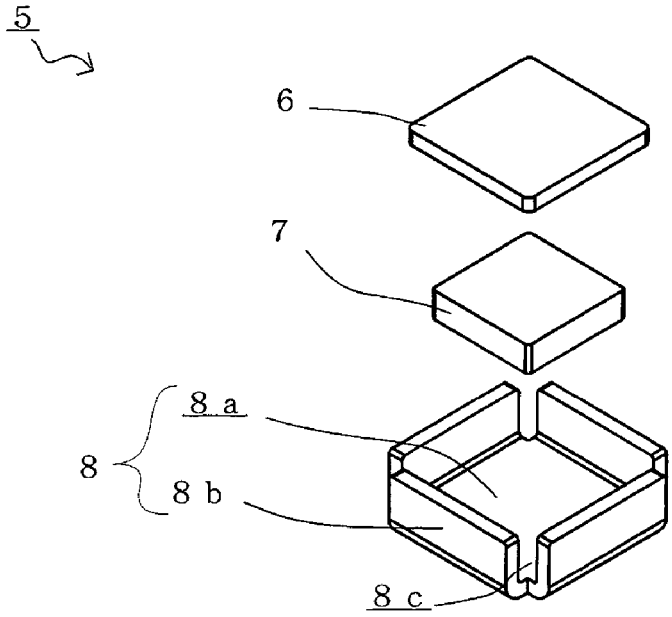
FIG. 3 is an exploded view for explaining a magnetic circuit of the loudspeaker of the present invention (Embodiment 1).

FIG. 3 is an exploded view for explaining the magnetic circuit 5 of the present embodiment. The magnetic circuit 5 is constructed by bonding a plate 6, a magnet 7 and a yoke 8 with an adhesive. The plate 6 and the yoke 8 are formed of a magnetic material such as soft iron and permalloy. The plate 6 is a substantially rectangular parallelepiped member with a thickness of about 2 mm. Moreover, the magnet 7 is a substantially rectangular parallelepiped magnet, and is made of a magnetic material including rear earths such as neodymium. The yoke 8 has a substantially U-shaped cross section along A-A', and includes a substantially rectangular, planar bottom portion 8*a*, and side wall portions 8*b* extending in four directions from this bottom portion 8*a*, and further, insertion grooves 8*c* are each formed between the side wall portions 8*b*.

The magnetic circuit 5 includes the yoke 8 to which the magnet 7 capped by the rectangular flat plate 6 is bonded, and a rectangular magnetic gap is formed between the plate 6 and the side wall portions 8*b* of the yoke 8. In the rectangular magnetic gap, a magnetic field exhibiting high magnetic flux density is formed. The magnetic circuit 5 has the insertion grooves 8*c* communicating with the rectangular magnetic gap at corner portions of the rectangular magnetic gap corresponding to a rectangular reinforcing member 14 of the voice coil assembly 10 described later. Since the frame 4 joins three magnetic circuits 5 each having the rectangular magnetic gap in a grid pattern, one-sides of the rectangular magnetic gaps of the magnetic circuits 5 are arranged on the same straight line, and also the insertion grooves 8*c* of the magnetic circuits 5 are arranged on the same straight line.

Figure 4:
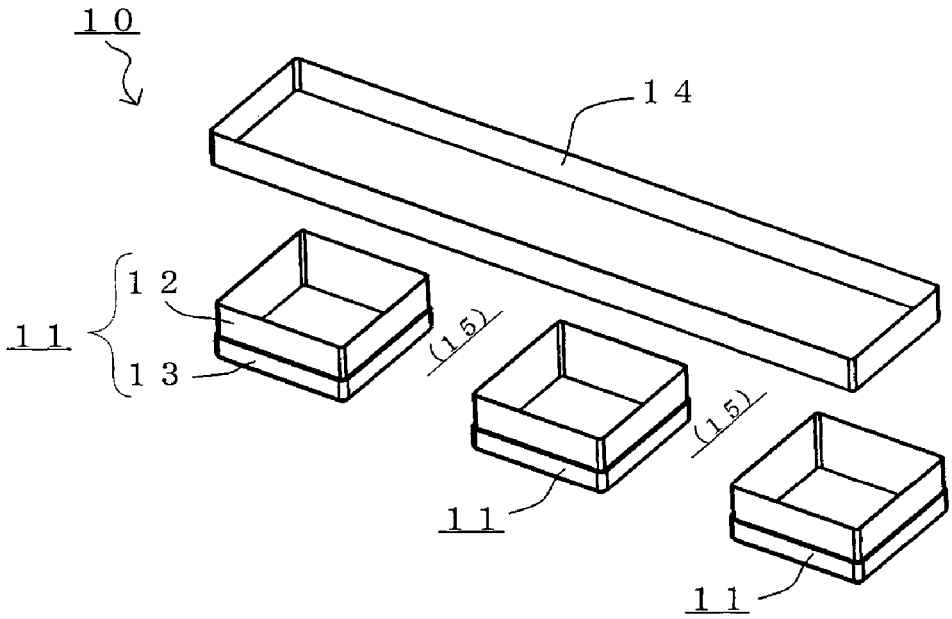
FIG. 4 is an exploded view for explaining a voice coil assembly of the present invention (Embodiment 1).

FIG. 4 is an exploded view for explaining the voice coil assembly 10 of the present embodiment. The voice coil assembly 10 includes a total of three rectangular voice coils 11, and the reinforcing member 14 coupling these to one another in a grid pattern of one row and three columns. Each of the rectangular voice coils 11 includes a rectangular bobbin 12 formed using aluminum with a thickness of about 0.08 mm as a base material so that a cross-sectional shape is a rectangle of about 20.5 mm×about 20.5 mm and an overall height is about 8.5 mm, and a rectangular coil 13 bonded to this rectangular bobbin 12. The rectangular coil 13 of the present embodiment is an outer-winding rectangular coil fixed to a one-end side of the outer wall surfaces of the rectangular bobbin 12, and having an overall height of about 2.9 mm, and these are joined with an adhesive. Accordingly, in each of the rectangular voice coils 11, the outer wall surfaces of the rectangular bobbin 12 are exposed to the outer surface side by about 5.1 mm on the other end side to which the rectangular coil 13 is not bonded.

On the other hand, the rectangular reinforcing member 14 is a member formed using aluminum with a thickness of about 0.05 mm as a base material so that an overall height is about 5 mm and a cross-sectional shape is a rectangle of about 104.1 mm×about 21.4 mm. In the rectangular reinforcing member 14, the outer wall surfaces of the rectangular bobbins 12 are bonded to inner wall surfaces of the rectangular reinforcing member 14 with an adhesive to couple the rectangular voice coils 11 to one another, so that the voice coil assembly 10 is constructed. That is, in the voice coil assembly 10, a portion of the inner wall surfaces of the rectangular reinforcing member 14 is bonded to any of the outer wall surfaces of each of the rectangular bobbins 12 of the plurality of rectangular voice coils 11. Moreover, in the voice coil assembly 10, the outer wall surfaces of the rectangular bobbins 12 to which the inner wall surfaces of the rectangular reinforcing member 14 are not bonded, and portions of the inner wall surfaces of the rectangular reinforcing member 14, which are not bonded to the outer wall surfaces of the rectangular bobbins 12, define a rectangular space 15 of about 20.8 mm×about 20.8 mm between a pair of the adjacent rectangular voice coils 11, and the rectangular reinforcing member 14 couples the rectangular voice coils 11 apart from one another in a substantially grid pattern. Since for the rectangular reinforcing member 14, the same material as that of the rectangular bobbins 12 can be used, the manufacturing cost of the voice coil assembly 10 can be reduced.

Moreover, since the rectangular reinforcing member 14 of the voice coil assembly 10 defines the rectangular spaces 15 each between the pair of adjacent voice coils 11, as shown in FIG. 2, the use of these rectangular spaces 15 can decrease operational failures of the loudspeaker 1 and reduce a thickness thereof. That is, portions of the rectangular reinforcing member 14 forming the rectangular spaces 15 are arranged in the insertion grooves 8*c* of the magnetic circuits 5, and thus, even if the voice coil assembly 10 joined to the flat diaphragm 2 vibrate vertically, the voice coil assembly 10 hardly comes into contact with the magnetic circuits 5. The loudspeaker 1 can stabilize operation of a vibrating system including the flat diaphragm 2 and the voice coil assembly 10, and realize favorite audio reproduction by including the dampers.

Moreover, the use of the rectangular spaces 15 of the voice coil assembly 10 allows the dampers 9 vibratably supporting the voice coil assembly 10 to be provided. The dampers 9 of the present embodiment are substantially rectangular dampers corresponding to the rectangular spaces 15 in two positions, and each have a fixing portion that is fixed to the frame 4, and a joining portion that is joined to the rectangular reinforcing member 14 of the voice coil assembly 10, and a support movable portion formed between the fixing portion and the joining portion. The dampers 9 are manufactured by heat molding process with a die, using, as a base material, prepreg obtained by impregnating woven fabric of cotton yarn, aramid fiber yarn or the like with resin such as phenol resin and melamine resin. The fixing portion of the damper 9 includes an inner fixing portion located inside the rectangular space 15, and an outer fixing portion located outside the rectangular space 15, and the joining portion of the damper 9 joins to the rectangular reinforcing member 14 having the overall height smaller than the overall height of the voice coil assembly 10, and thus, contact with the magnetic circuit 5 is avoided and the thickness of the loudspeaker 1 can be reduced.

Figure 5:
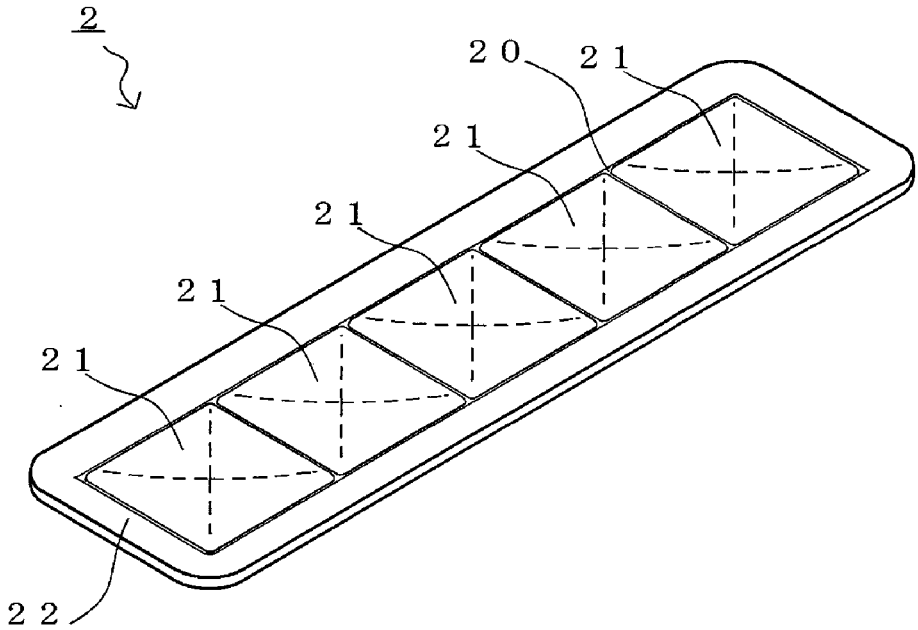
FIG. 5 is a perspective view for explaining a loudspeaker diaphragm of the present invention (Embodiment 1).

FIG. 5 is a perspective view for explaining the flat diaphragm 2 of the present embodiment, in which the back surface side of the flat diaphragm 2 is exposed. The flat diaphragm 2 is a planer loudspeaker diaphragm formed with a constant thickness by a vacuum molding method combined with plug-assist, using expanded PP (polypropylene) with a thickness of about 1.5 mm as a base material. In the flat diaphragm 2, grid convex surfaces, which are elevated on the front surface side, and grid concave surfaces, which are depressed on the back surface side, are formed, and the flat diaphragm 2 includes, on the back surface side, a grid joining portion 20 that joins the voice coil assembly including the plurality of rectangular coils, five rectangular vibrating surface portions 21 defined inside the grid joining portion 20, and an outer-peripheral vibrating surface portion 22 defined outside the grid joining portion 20.

Namely, the grid joining portion 20 of the flat diaphragm 2 is a groove portion that forms the grid concave surfaces, which are depressed on the back surface side and have a depth of about 1.0 mm to join the voice coil assembly 10 on the back surface side, and forming the grid convex surfaces which are elevated on the front surface side. Accordingly, the grid joining portion 20 acts as a rib to increase the overall rigidity of the flat diaphragm 2, and at the same time, defines the five rectangular vibrating surface portions 21 inside the grid joining portion 20 and the outer-peripheral vibrating surface portion 22 outside the grid joining portion 20. To the outer-peripheral vibrating surface portion 22 is joined the inner peripheral end side of the edge 3.

Moreover, each of the rectangular vibrating surface portions 21 of the flat diaphragm 2 has a convex cross-sectional shape on the front surface side, as shown in figure. Since these rectangular vibrating surface portions 21 defined inside the grid joining portion 20 occupy the largest area as a radiation area of the flat diaphragm 2, each of the plurality of the rectangular vibrating surface portions preferably has a convex cross-sectional shape or a concave cross-sectional shape on the front surface side to have a sufficient rigidity. In the rectangular vibrating surface portions 21 at both ends and in the center of the five rectangular vibrating surface portions 21, the rectangular bobbins 12 making up the voice coil assembly 10 are bonded to the grid joining portion 20 on the back surface side. On the other hand, in the other two rectangular vibrating surface portions 21, the rectangular reinforcing member 14 making up the voice coil assembly 10 is bonded to the grid joining portions 20 on the back surface side.

Since the three magnetic circuits 5 of the present embodiment are magnetic circuits magnetized in the same direction, in the voice coil assembly 10, the three rectangular coils 13 of a DC resistance r (=about 2.5Ω) are connected in series so that an audio signal current I in the respective rectangular coils 13 flows in the same rotational direction. Accordingly, drive forces generated in the respective rectangular coils 13 are aligned in the same direction of either upward or downward in the figure, and thus, the voice coil assembly 10 coupling the rectangular bobbins 12 to one another with the rectangular reinforcing member 14 can vertically drive the whole surface of the joined flat diaphragm 2. In the voice coil assembly 10 of the present embodiment, since the rectangular bobbins 12 and the rectangular reinforcing member 14 are formed of the aluminum material, which is lightweight and has sufficient rigidity when it is formed into a rectangle, sufficient strength to drive the whole surface of the flat diaphragm 2 can be ensured without employing a structure in which the rectangular voice coils 11 stick to one another. The loudspeaker 1 can bring about smooth frequency characteristics with split vibration hardly caused by driving the whole surface of the flat diaphragm 2.

Moreover, in the loudspeaker 1 of the present embodiment, since even when each of the rectangular space 15 is provided between the pair of adjacent rectangular voice coils 11 to make the number of the rectangular coils 13 generating the drive force smaller than that in the related art, the weight is decreased by the reduction of the rectangular coils 13 made of metal conductive wires including copper or aluminum, thaus, the weight of the voice coil assembly 10 can be reduced and the reproduction efficiency of the loud loudspeaker 1 can be increased. Further, in the voice coil assembly 10 of the present embodiment, the rectangular reinforcing member 14 is bonded to the outer wall surfaces of the rectangular bobbins 12 instead of being held between the flat diaphragm 2 and the rectangular bobbins 12. Accordingly, the above-described structure has an advantage that the drive force by the three rectangular voice coils 11 of the voice coil assembly 10 is directly transmitted from the rectangular bobbins 12 to the flat diaphragm 2, so that a high limit frequency becomes high and a wide reproduction frequency band can be ensured.

The rectangular bobbins 12 of the voice coil assembly 10 or the rectangular reinforcing member 14 may be formed of any material of a paper material such as craft paper and spiral paper, and a resin material such as Kapton, Silter, Til, or a metal material including titanium other than aluminum, and the rectangular bobbins 12 and the rectangular reinforcing member 14 may use the different materials, respectively, instead of using the same material. Moreover, the flat diaphragm 2 may be formed of another expanded resin material, for example, may be a molded plate of PSP (polystyrene paper), and also, the edge 3 may be in a corrugation shape including a material, for example, such as another cloth and rubber (material: expanded rubber).

Moreover, while the rectangular coils 13 included in the voice coil assembly 10 of the present embodiment are the outer-winding rectangular coils fixed to the outer wall surfaces of the rectangular bobbins 12, they may be inner-winding rectangular coils fixed to the inner wall surfaces of the rectangular bobbins 12. In the case of the outer-winding rectangular coil, since manufacturing of the rectangular voice coil is easier, manufacturing cost of the voice coil assembly 10 can be reduced. Moreover, in the case of the inner-winding rectangular coil, an area of the bonding surfaces between the rectangular bobbin 12 to which the inner-winding rectangular coil is bonded and the rectangular reinforcing member 14 can be made larger than that in the outer-winding rectangular coil 13, which can further increase the strength of the voice coil assembly 10.

Moreover, since the magnetic circuits 5 of the loudspeaker 1 need not be magnetic circuits for loudspeaker including a plurality of magnets arranged so that magnetic polarities of the adjacent magnets are different from each other, magnetization is enabled by one magnetization process, and a magnetic field having high magnetic flux density can be generated in the magnetic gap. That is, for the magnetic circuits 5 of the present embodiment, two types of magnets different in magnetic polarity, which have been magnetized in different directions in advance, need not be prepared, thereby improving work efficiency in manufacturing. There is an advantage that the action of magnetic force, which is a problem in assembling magnetized first and second magnets different in magnetic polarity, need not be considered. Since the necessity of handling the magnetized small magnets alone at the time of assembling work of the magnetic circuits 5 is eliminated, the work efficiency is largely increased.

Embodiment 2

Figure 6:
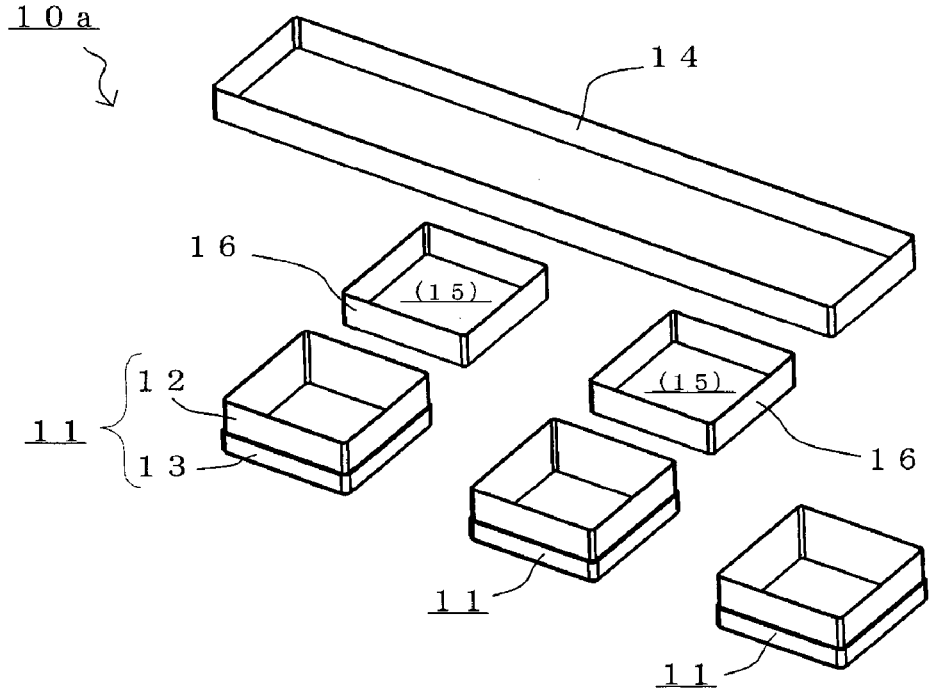
FIG. 6 is an exploded view for explaining another voice coil assembly of the present invention (Embodiment 2).

FIG. 6 is an exploded view for explaining a voice coil assembly 10*a* according to another preferred embodiment of the present invention. The voice coil assembly 10*a*, in place of the voice coil assembly 10 of the previous embodiment, is a member making up a vibrating system of a loudspeaker 1*a* (not shown), and includes the totally three rectangular voice coils 11, and the rectangular reinforcing member 14 coupling these to one another in a grid pattern of one row and three columns, and further includes two reinforcing rectangular bobbins 16 each formed with a rectangular cross section. Between the loudspeaker 1*a* of the present embodiment and the loudspeaker 1 of the previous embodiment, configurations other than the configuration of the voice coil assembly are common. Accordingly, the same portions as those of the previous embodiment are given the same reference numerals, and descriptions thereof are omitted.

The reinforcing rectangular bobbins 16 making up the voice coil assembly 10*a* are formed using aluminum with a thickness of about 0.08 mm as a base material so that a cross-sectional shape is a rectangle of about 20.5 mm×about 20.5 mm and an overall height is about 5.0 mm. The two reinforcing rectangular bobbins 16 are joined with an adhesive so as to be sandwiched between the three rectangular voice coils 11 arranged in an isolated state from one another, and the rectangular reinforcing member 14 is wound around the outer peripheral side thereof. Accordingly, outer wall surfaces of the reinforcing rectangular bobbins 16 are bonded to portions of the inner wall surfaces of the rectangular reinforcing member 14, and the outer wall surfaces of the rectangular bobbins 12 to which the inner wall surfaces of the rectangular reinforcing member 14 of the pair of adjacent voice coils 11 in the grid pattern. Moreover, in the voice coil assembly 10*a*, these two reinforcing rectangular bobbins 16 each define the rectangular space 15.

That is, in the voice coil assembly 10*a*, the rectangular spaces 15 constructed by not only the rectangular reinforcing member 14 but also the reinforcing rectangular bobbins 16 are each provided between the pair of adjacent rectangular voice coils 11, so that the rectangular voice coils 11 are coupled apart from one another in the substantially grid pattern. Accordingly, in the voice coil assembly 10*a*, sufficient strength to drive the whole surface of the flat diaphragm 2 can be ensured without employing the structure in which the rectangular voice coils 11 stick to one another. Moreover, as in the present embodiment, by the configuration where the rectangular reinforcing member 14 and the reinforcing rectangular bobbins 16 are made of the same material as that of the rectangular bobbins 12, manufacturing cost of the voice coil assembly 10*a* can be reduced.

Figure 7:
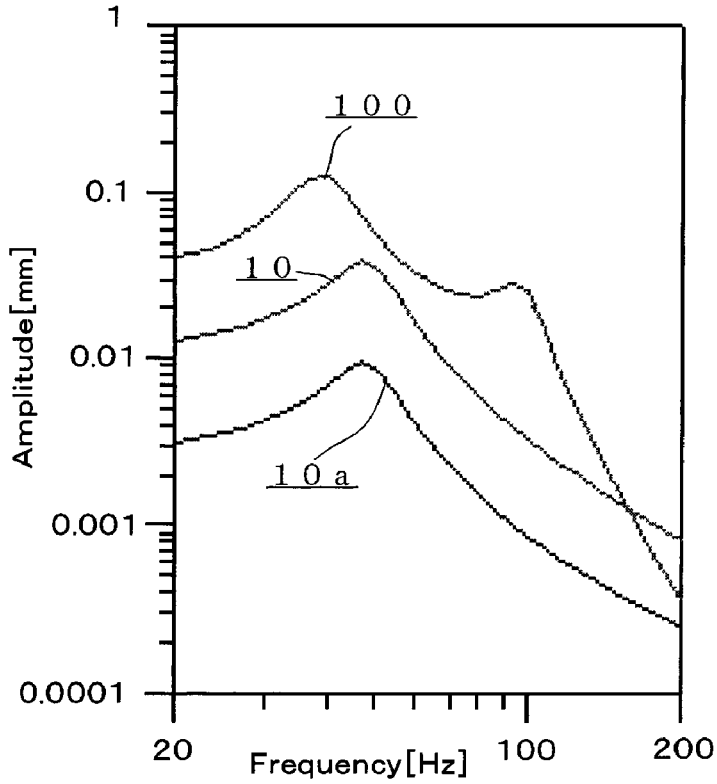
FIG. 7 is a graph for explaining displacement characteristics of the loudspeaker of the present invention (Embodiments 1, 2).

FIG. 7 is a graph for explaining displacement characteristics at a certain point of the voice coil assembly of the loudspeaker 1 of the present invention. Specifically, it is a graph indicating displacement in an A-A' direction perpendicular to the vertical direction, in which the voice coil assembly is mainly displaced, and a displacement amount of rolling vibration of the voice coil assembly, at one outermost point of each of the rectangular voice coils 11 at both ends among the three rectangular voice coils 11 making up the voice coil assembly. In the loudspeaker 1, in order to stabilize the operation of the vibrating system including the flat diaphragm 2 and the voice coil assembly 10 to realize favorable audio reproduction, it is preferable that the voice coil assembly does not come into contact with the magnetic circuits, and level of the displacement of the rolling vibration in the voice coil assembly is preferably lower.

In FIG. 7, the case of the voice coil assembly 10*a* of the present embodiment, the case of the voice coil assembly 10 of the previous embodiment, and a case of a set 100 made up of only the three rectangular voice coils 11 (not shown) as a comparative example are shown. That is, the set 100 of the rectangular voice coils 11 as the comparative example is a case where in the voice coil assembly 10 of the previous embodiment, the rectangular reinforcing member 14 is not included, and the three rectangular voice coils 11 are independent. In the comparative example not including the rectangular reinforcing member 14, the level of the displacement of the rolling vibration in the rectangular voice coil 11 is higher than that of the other embodiments, and the displacement becomes larger in the vicinity of 40 Hz and 100 Hz by resonance. Moreover, in the comparative example, the drive force is insufficient to drive the whole surface of the flat diaphragm 2, split vibration is easily caused, and peaks/dips are observed in sound pressure frequency characteristics.

On the other hand, in the case of the voice coil assembly 10 of the previous embodiment, since the provision of the rectangular reinforcing member 14 increases the rigidity, the rolling vibration is suppressed as compared with the comparative example. Moreover, in the voice coil assembly 10*a* of the present embodiment, the provision of the reinforcing rectangular bobbins 16 further increases the rigidity, so that the rolling vibration can be suppressed most. That is, in the case of the voice coil assembly 10 of the previous embodiment, or in the case of the voice coil assembly 10*a* of the present embodiment, the whole-surface drive of the flat diaphragm 2 can bring about smooth sound pressure frequency characteristics with split vibration hardly caused.

While in the case of the loudspeaker 1 of the embodiments, the voice coil assembly 10 or 10*a* is in the grid pattern of one row, in which the two rectangular spaces 15 are arranged between the three rectangular voice coils 11, the voice coil assembly is not limited to these cases of one row, but a grid pattern of two or more rows and columns in the vertical direction and in the horizontal direction may be employed. The loudspeaker 1 can correspond to demand for various design changes, and preparation of the frame 4 joining the respective magnetic circuits 5 with high magnetic efficiency enables the correspondence to the flat diaphragms 2 having various sizes, and consequently, enables the construction of the loudspeaker driving the whole surface of these.

Figure 8:
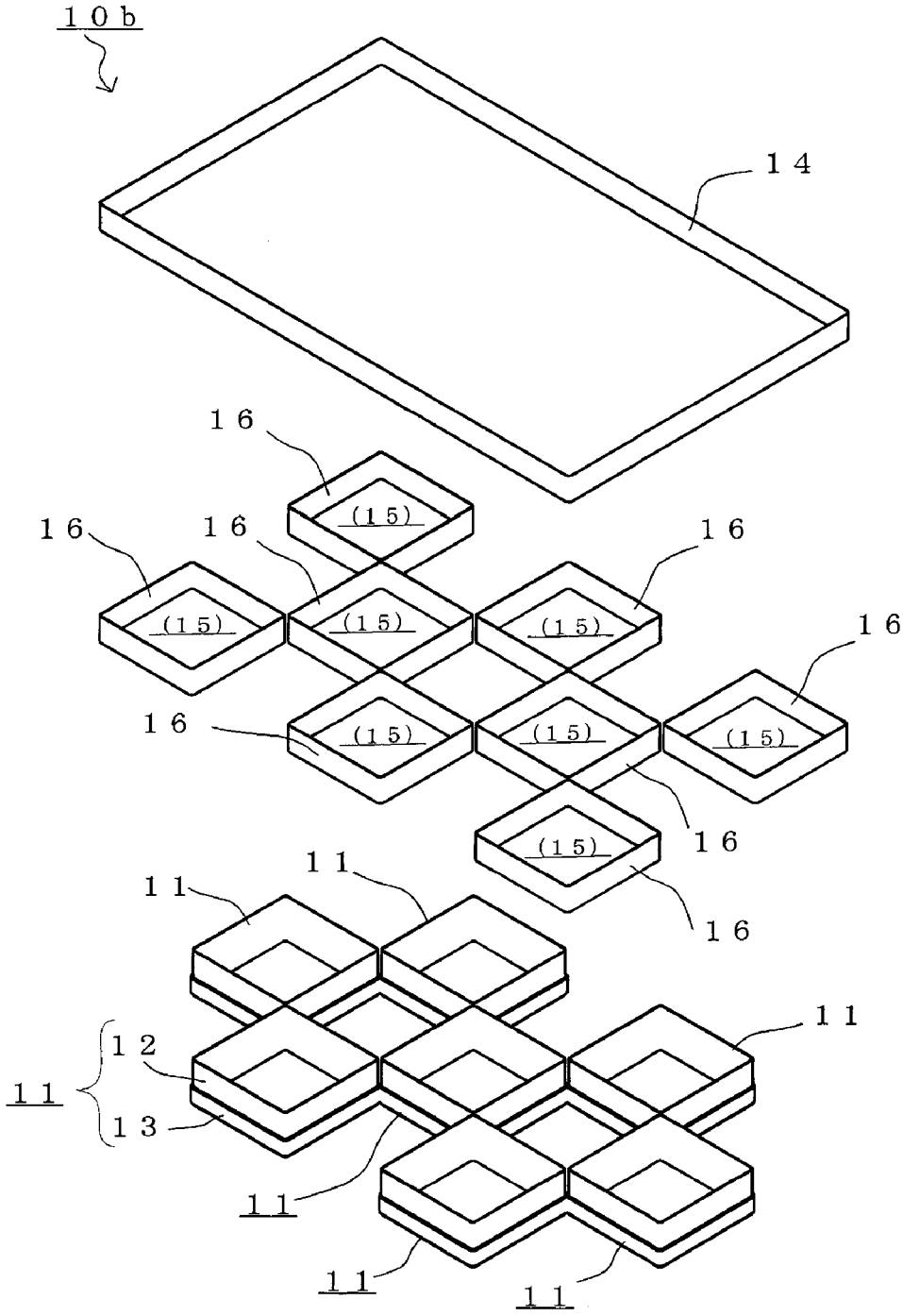
FIG. 8 is an exploded view for explaining another voice coil assembly of the present invention (Embodiment 2).

For example, FIG. 8 is an exploded view for explaining a configuration of a voice coil assembly 10*b* according to another preferred embodiment of the present invention. While the voice coil assembly 10*b* includes the reinforcing rectangular bobbins 16 as in the voice coil assembly 10*a* of the previous embodiment, the rectangular reinforcing member 14 joins the totally seven rectangular voice coils 11 and the totally eight reinforcing rectangular bobbins 16 in a grid pattern of three rows and five columns. The rectangular voice coils 11 and the reinforcing rectangular bobbins 16 are arranged in order so as to be adjacent to one another. Accordingly, when this voice coil assembly 10*b* is used, a loudspeaker that drives the whole surface of a flat diaphragm with external dimensions of about 115 mm×70 mm can be realized.

Embodiment 3

Figure 9:
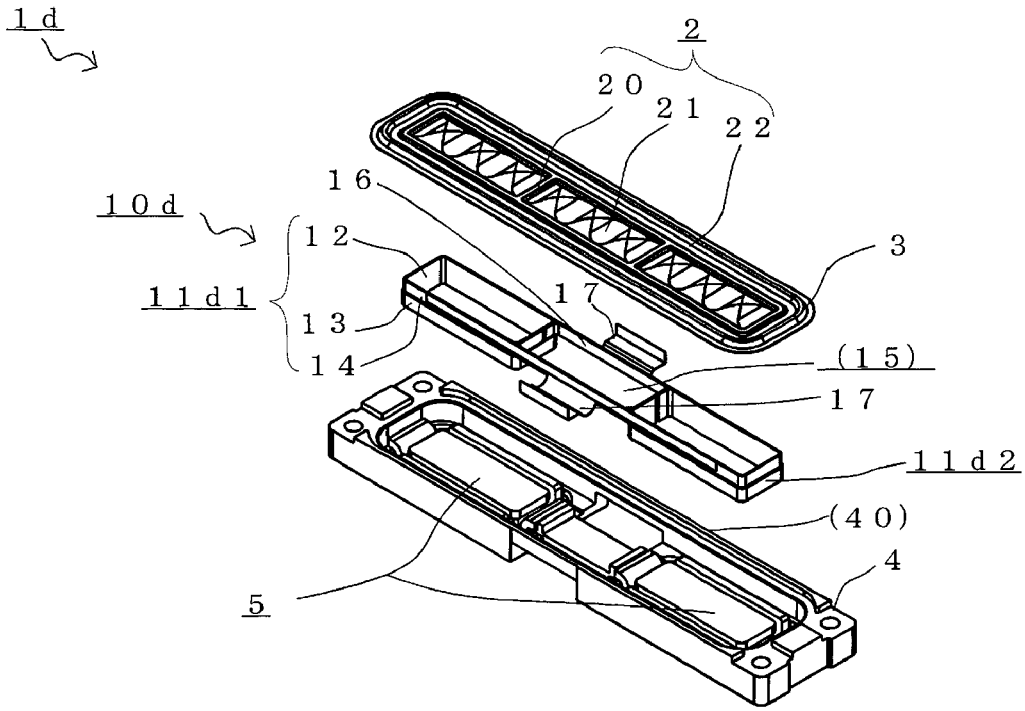
FIG. 9 is an exploded view for explaining another loudspeaker of the present invention (Embodiment 3).

FIG. 9 is an exploded view for explaining a configuration of a loudspeaker 1*d* according to another preferable embodiment of the present invention, and is a perspective view excluding some components unnecessary for the explanation. The loudspeaker 1*d* includes the square flat diaphragm 2, a voice coil assembly 10*d*, the frame 4, and the two magnetic circuits 5 including magnets, and realizes a whole-surface driven flat thin loudspeaker having an elongated shape, which is different from the loudspeaker 1 of the previous embodiment in external dimensions. Accordingly, portions common to the previous embodiment are given the same reference numerals and descriptions thereof are omitted. The frame 4 of FIG. 9 has, on the back surface side, a loudspeaker terminal 40 connected to the voice coil assembly 10*d* (not shown).

Figure 10:
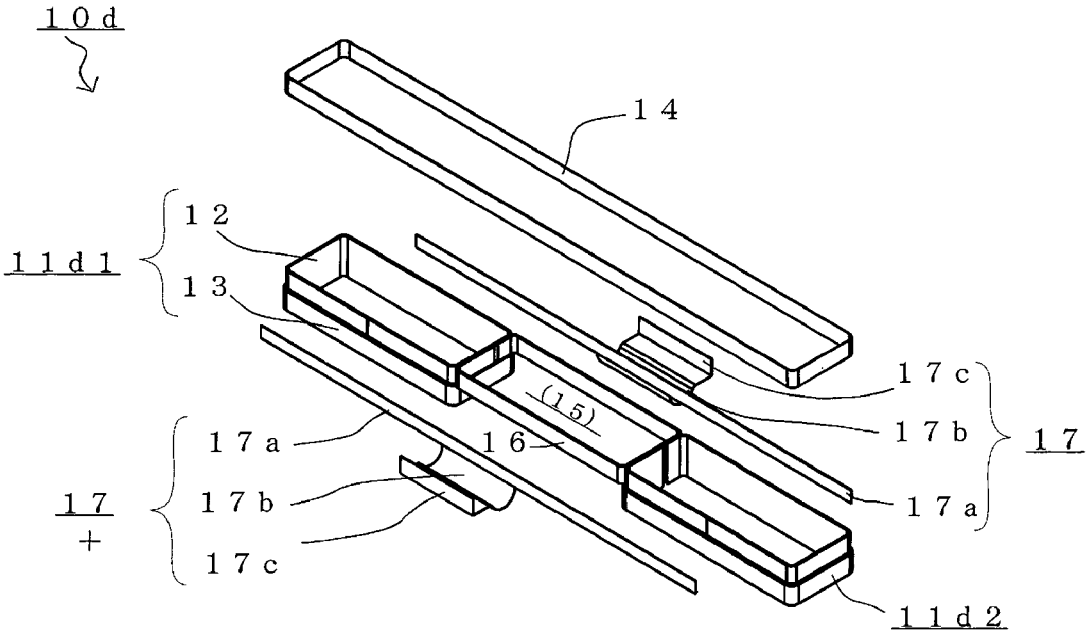
FIG. 10 is an exploded view for explaining another voice coil assembly of the present invention (Embodiment 3).

FIG. 10 is an exploded view for explaining the voice coil assembly 10*d*. The voice coil assembly 10*d* is a member making up a vibrating system of the loudspeaker 1*d* similarly to the voice coil assembly 10 of the previous embodiment, and includes a pair of the totally two rectangular voice coils 11 (specifically, 11*d*1 and 11*d*2), and the rectangular reinforcing member 14 coupling these in one row, and the one reinforcing rectangular bobbin 16 formed with a rectangular cross section. In this voice coil assembly 10*d*, the rectangular voice coil 11 and the reinforcing rectangular bobbin 16 are each formed into a long rectangle in a long axis direction. Moreover, the voice coil assembly 10*d* includes conductive reinforcing members 17 that are formed of two pieces of metal foil and serve as dampers and connection wires.

The rectangle voice coil 11 includes the rectangular bobbin 12 formed using aluminum with a thickness of about 0.08 mm as a base material so that a cross-sectional shape is a rectangle of about 23.5 mm×about 8.0 mm and an overall height is about 4.7 mm, and the rectangular coil 13 bonded to this rectangular bobbin 12. The rectangular coil 13 of the present embodiment is an outer-winding rectangular coil fixed to the one-end side of the outer wall surfaces of the rectangular bobbin 12, and having an overall height of about 2.3 mm, and these are joined with an adhesive. Accordingly, in each of the rectangular voice coils 11, the outer wall surfaces of the rectangular bobbin 12 are exposed to the outer surface side by about 2.1 mm on the other end side to which the rectangular coil 13 is not bonded.

On the other hand, the rectangular reinforcing member 14 is a member formed using craft paper with a thickness of about 0.05 mm as a base material so that an overall height is about 1.5 mm and a cross-sectional shape is a rectangle of about 70.0 mm×about 8.0 mm. In the rectangular reinforcing member 14, the outer wall surfaces of the rectangular bobbins 12 are bonded to inner wall surfaces of the rectangular reinforcing member 14 with an adhesive to couple rectangular voice coils 11*d*1 and 11*d*2, so that the voice coil assembly 10*d* is constructed. Moreover, the reinforcing rectangular bobbin 16 making up the voice coil assembly 10*d* is formed using aluminum with a thickness of about 0.08 mm as a base material so that a cross-sectional shape is an rectangle of about 23.0 mm×about 8.0 mm and an overall height is about 2.0 mm. The reinforcing rectangular bobbin 16 is joined with an adhesive so as to be sandwiched between the two rectangular voice coils 11*d*1 and 11*d*2, and the rectangular reinforcing member 14 is wound on the outer peripheral side thereof. Accordingly, the outer wall surfaces of the reinforcing rectangular bobbin 16 are bonded to portions of the inner wall surfaces of the rectangular reinforcing member 14, and the outer wall surfaces of the rectangular bobbins 12 to which the inner wall surfaces of the rectangular reinforcing member 14 of the pair of rectangular voice coils 11*d*1 and 11*d*2 are not bonded. Moreover, in the voice coil assembly 10*d*, this reinforcing rectangular bobbin 16 defines the rectangular space 15.

Each of the conductive reinforcing members 17 is formed of conductive and elastic metal foil of phosphor bronze with a thickness of about 50 μm. A base body 17*a* of the conductive reinforcing member 17 is a strip portion with a length in the long axis direction of about 60.0 mm, and an overall height of about 1.5 mm. The base body 17*a* of the conductive reinforcing member 17 has the overall length larger than one side in the long axis direction of the rectangular space 15 (about 23.0 mm) defined between the pair of adjacent rectangular voice coils 11*d*1 and 11*d*2, and thus, when the base body 17*a* is fixed to a portion that is the outer wall surface of the rectangular reinforcing member 14 and corresponds to border portions between the rectangular voice coils 11 and the rectangular space 15, the base body 17*a* reinforces these border portions. In the present embodiment, the portion corresponding to the border portions between the rectangular voice coils 11 and the rectangular space 15 is a portion to which the outer wall surfaces of the rectangular bobbins 12 and the outer wall surface of the reinforcing rectangular bobbin 16 are bonded when a side surface of the voice coil assembly 10*d* is viewed from a short axis direction.

That is, the two conductive reinforcing members 17 are attached so as to sandwich a long axis of the rectangular reinforcing member 14, and each reinforce the border portion between the rectangular voice coil 11*d*1 and the reinforcing rectangular bobbin 16, the reinforcing rectangular bobbin 16 defining the rectangular space 15, and the border portion between the reinforcing rectangular bobbin 16 and the rectangular voice coil 11*d*2. Accordingly, in the voice coil assembly 10*d*, sufficient strength to drive the whole surface of the flat diaphragm 2 can be ensured. The loudspeaker 1*d* can bring about smooth frequency characteristics with split vibration hardly caused by driving the whole surface of the flat diaphragm 2.

Moreover, to the base body 17*a* of the conductive reinforcing member 17 is conductively connected one end of a lead wire of each of the rectangular voice coils 11*d*1 and 11*d*2. The one end of the lead wire of the coil is soldered to a surface of the base body 17*a* of the conductive reinforcing member 17. In the voice coil assembly 10*d* shown in FIG. 9 or FIG. 10, to the conductive reinforcing member 17 in the foreground is connected one end of winging start of the lead wire of each of the rectangular voice coils 11*d*1 and the 11*d*2. On the other hand, to the conductive reinforcing member 17 on the back side is connected one end of winding end of the lead wire of each of the rectangular voice coils 11*d*1 and 11*d*2. Accordingly, the conductive reinforcing members 17 are connected the rectangular voice coils 11*d*1 and 11*d*2 in parallel.

Furthermore, the base body 17*a* of the conductive reinforcing member 17 further includes a damper movable portion 17*b* extended integrally from a vicinity of the center thereof with a roll-shaped cross section, and a plate-shaped damper fixing portion 17*c* extended from the damper movable portion 17*b* and folded back. The damper fixing portion 17*c* is fixed to a frame 5 with an adhesive. Accordingly, since the damper movable portions 17*b* can be deformed with the vibration of the voice coil assembly 10*d*, the two conductive reinforcing members 17 serve as dampers vibratably supporting the voice coil assembly 10*d*, in place of the dampers 9 in the previous embodiment. In the loudspeaker 1*d* using this voice coil assembly 10*d*, the provision of the dampers stabilizes the operation of the vibration system including the flat diaphragm 2 and the voice coil assembly 10*d*, so that favorable audio reproduction can be realized.

Moreover, the damper fixing portion 17*c* extended from the base body 17*a* of the conductive reinforcing members 17 is fixed to the frame 4 and is connected to the loudspeaker terminal 40 (not shown) provided in the frame 4 so as to be conducted through a connection wire (not shown). That is, a positive terminal of the loudspeaker terminal 40 (not shown) is connected to the conductive reinforcing member 17 in the foreground shown in FIGS. 9 and 10 through the connection wire, and a negative terminal of the loudspeaker terminal 40 (not shown) is connected to the conductive reinforcing member 17 on the back side through the connection wire.

The shapes of the damper movable portion 17*b* and the damper fixing portion 17*c* of the conductive reinforcing member 17 are not limited to the shapes in the present embodiment. The damper movable portion 17*b* may be in a slimmer arm-like roll shape, or may be a curved one such as a butterfly damper. Moreover, the damper fixing portion 17*c* extended from the base body 17*a* of the conductive reinforcing member 17 may be formed with not only the plate-like portion fixed to the frame 4, but also an further extended piece portion as a loudspeaker terminal (not shown) in place of the loudspeaker terminal 40 provided in the frame 4. Forming the conductive reinforcing member 17 as described above allows the foregoing connection wire that conducts between the damper fixing portion 17*c* and the loudspeaker terminal to be omitted.

In the loudspeaker 1*d*, since an audio signal can be supplied to the rectangular voice coils 11*d*1 and 11*d*2 through the damper movable portions 17*b* and the damper fixing portions 17*c* of the two conductive reinforcing members 17 making up the dampers, the connection wires such as tinsel wires to supply the audio signal can be eliminated. Since the damper movable portions 17*b* and the damper fixing portions 17*c* of the conductive reinforcing members 17 are joined to the rectangular reinforcing member 14 having the overall height smaller than the overall height of the voice coil assembly 10*d*, contact with the magnetic circuits 5 is avoided, so that reduction in thickness of the loudspeaker 1*d* can be achieved. Moreover, since the connection wires such as the tinsel wires can be eliminated, further reduction in thickness of the loudspeaker 1*d* can be achieved.

Each of the base bodies 17*a* of the conductive reinforcing members 17 may have at least enough length to be fixed to the portion that is the outer wall surface of the rectangular reinforcing member 14, and corresponds to the border portions between the rectangular voice coils 11 and the rectangular space 15 (e.g., about 25 mm to 70 mm). Moreover, while as the configuration to vibratably support the voice coil assembly 10*d*, the two conductive reinforcing members 17 each having the damper movable portion 17*b* and the damper fixing portion 17*c* are used in the present embodiment, for example, using four conductive reinforcing members having base bodies of a length shorter than that of the present embodiment and corresponding to the border portions between the rectangular voice coils 11 and the rectangular spaces 15 in four positions, the voice coil assembly 10*d* may be reinforced and supported vibratably. Furthermore, while the conductive reinforcing members 17 of the present embodiment connect the rectangular voice coils 11*d*1 and 11*d*2 in parallel, the voice coil assembly 10*d* may use at least three or more conductive reinforcing members to connect the rectangular voice coils 11*d*1 and 11*d*2 in series.

Embodiment 4

FIG. 11 is an exploded view for explaining a voice coil assembly 10*e* according to another preferred embodiment of the present invention. The voice coil assembly 10*e* is a member making up the vibration system of the loudspeaker 1*d* similarly to the voice coil assembly 10*d* of the previous embodiment, and is common to the voice coil assembly 10*d* in that it includes a pair of the totally two rectangular voice coils 11 (specifically, 11*d*1 and 11*d*2), the rectangular reinforcing member 14 coupling these to one another in one row, and the one reinforcing rectangular bobbin 16 formed with a rectangular cross section. Accordingly, portions common to the previous embodiment are given the same reference numerals and descriptions thereof are omitted.

The voice coil assembly 10*e* of the present embodiment is different in that it includes two conductive reinforcing members 18 formed of metal foil and serving as the connection wires, in place of the two conductive reinforcing members 17 in the previous embodiment. A one-end side of tinsel wires 19 are soldered and fixed to the conductive reinforcing members 18. The loudspeaker using this voice coil assembly 10*e* may further include a damper (not shown) in order to realize favorite audio reproduction.

Each of the conductive reinforcing members 18 is formed of conductive and elastic metal foil of phosphor bronze with a thickness of about 50 μm. The conductive reinforcing member 18 is a strip portion with a length in the long axis direction of about 60.0 mm and an overall height of about 1.5 mm. Since the conductive reinforcing members 18 each have the overall length larger than one side in the long axis direction (about 23.0 mm) of the rectangular space 15 defined between the pair of adjacent rectangular voice coils 11*d*1 and 11*d*2, fixing the conductive reinforcing member 18 to the portion that is the outer wall surface of the rectangular reinforcing member 14 and corresponds to the border portions between the rectangular voice coils 11 and the rectangular space 15 allows these border portions to be reinforced. Accordingly, in the voice coil assembly 10*e*, sufficient strength to drive the whole surface of the flat diaphragm 2 can be ensured. The loudspeaker 1*e* can bring about smooth frequency characteristics with split vibration hardly caused by driving the whole surface of the flat diaphragm 2.

Moreover, to each of the conductive reinforcing members 18 is conductively connected one end of the leading wire of each of the rectangular voice coils 11*d*1 and 11*d*2. In the voice coil assembly 10*e* shown in FIG. 11, to the conductive reinforcing member 18 in the foreground is connected one end of winging start of the leading wire of each of the rectangular voice coils 11*d*1 and the 11*d*2. On the other hand, to the conductive reinforcing member 18 on the back side is connected one end of winding end of the leading wire of each of the rectangular voice coils 11*d*1 and 11*d*2. Accordingly, the conductive reinforcing members 18 connect the rectangular voice coils 11*d*1 and 11*d*2 in parallel.

Moreover, the conductive reinforcing members 18 are conductively connected through the tinsel wires 19 to the loudspeaker terminal 40 (not shown) provided in the frame 4. Accordingly, the positive terminal of the loudspeaker terminal 40 (not shown) is connected to the conductive reinforcing member 18 in the foreground shown in FIG. 11 through the tinsel wire 19 in the foreground, and the negative terminal of the loudspeaker terminal 40 (not shown) is connected to the conductive reinforcing member 18 on the back side through the tinsel wire 19 on the back side. In the loudspeaker 1*d* using the voice coil assembly 10*e*, the audio signal can be supplied to the rectangular voice coils 11*d*1 and 11*d*2 through two pairs of conductive reinforcing members 18 and the tinsel wires 19. As compared with the case of the conductive reinforcing members 17 in the previous embodiment, reduction in weight of the voice coil assemble 10*e* including the conductive reinforcing members 18 can be achieved, and thus, the loudspeaker 1*d* that increases a reproduction sound pressure level can be realized.

The conductive reinforcing members 17 or 18 may be formed of metal foil other than phosphor bronze, for example, such as beryllium copper. The conductive reinforcing members 17 or 18 may have any structure not limited to the strip shape but including a folded portion, as long as they are fixed to reinforce the portion that is the outer wall surface of the rectangular member 14 and corresponds to the border portions between the rectangular voice coils 11 and the rectangular space 15. Moreover, while in the conductive reinforcing members 17 or 18 of the previous embodiments, the one end portions of the lead wires of the voice coils 11*d*1 and 11*d*2 are connected to the conductive reinforcing members 17 or 18 to conduct the voice coils 11*d*1 and 11*d*2, when the rectangular voice coils 11*d*1 and the 11*d*2 are connected in series or in parallel by other means, the one end portions of the leading wires need not to be connected.

The voice coil assembly of the present invention and the loudspeaker using the same can be applied to not only the loudspeaker including the flat diaphragm, but also a headphone.

What is claimed is:

1. A voice coil assembly comprising a rectangular voice coil including a rectangular bobbin formed with a rectangular cross section and a rectangular coil bonded to the rectangular bobbin, and a rectangular reinforcing member coupling a plurality of rectangular voice coils to one another in a grid pattern, wherein a portion of inner wall surfaces of the rectangular reinforcing member is bonded to any of outer wall surfaces of each of the rectangular bobbins of the plurality of rectangular voice coils, and the outer wall surfaces of the rectangular bobbins to which the inner wall surfaces of the rectangular reinforcing member are not bonded, and portions of the inner wall surfaces of the rectangular reinforcing member, which are not bonded to the outer wall surfaces of the rectangular bobbins define a rectangular space between a pair of the adjacent rectangular voice coils.

2. The voice coil assembly according to claim 1, further comprising a reinforcing rectangular bobbin formed with a rectangular cross section, wherein outer wall surfaces of the reinforcing rectangular bobbin are bonded to portions of the inner wall surfaces of the rectangular reinforcing member, and the outer wall surfaces of the rectangular bobbins, to which the inner wall surfaces of the rectangular reinforcing member of the pair of adjacent rectangular voice coils in the grid pattern are not bonded, so that the reinforcing rectangular bobbin defines the rectangular space.

3. The voice coil assembly according to claim 1, wherein the rectangular bobbin, the rectangular reinforcing member or the reinforcing rectangular bobbin is formed of any material of a paper material of craft paper or spiral paper, a resin material of Kapton, Silter or Til, or a metal material including aluminum or titanium.

4. The voice coil assembly according to claim 1, wherein the rectangular coil is an outer-winding rectangular coil fixed to the outer wall surfaces of the rectangular bobbin.

5. The voice coil assembly according to claim 1, wherein the rectangular coil is an inner-winding coil fixed to inner wall surfaces of the rectangular bobbin.

6. The voice coil assembly according to claim 1, further comprising a conductive reinforcing member formed of metal foil, wherein the conductive reinforcing member is fixed to a portion that is the outer wall surface of the rectangular reinforcing member and corresponds to border portions between the rectangular voice coils and the rectangular space.

7. The voice coil assembly according to claim 6, wherein the conductive reinforcing member has an overall length larger than that of one side of the rectangular space defined between the pair of adjacent rectangular voice coils.

8. The voice coil assembly according to claim 6, wherein one end of a lead wire of each of the rectangular voice coils is conductively connected to the conductive reinforcing member, so that the conductive reinforcing member connects the plurality of rectangular voice coils in series or in parallel.

9. The voice coil assembly according to claim 6, wherein the conductive reinforcing member further comprises a damper movable portion integrally extended from a strip base body and a damper fixing portion extended from the damper movable portion.

10. A loudspeaker comprising the voice coil assembly according to claim 1, comprising: magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, and a frame to which an outer peripheral end of the edge and the magnetic circuits are joined, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps.

11. A loudspeaker comprising the voice coil assembly according to claim 8 including the plurality of conductive reinforcing members, magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, a frame to which an outer peripheral end of the edge and the magnetic circuits are joined, and a loudspeaker terminal provided in the frame, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps, and the conductive reinforcing members of the voice coil assembly are conductively connected to the loudspeaker terminal through connection wires or tinsel wires.

12. The loudspeaker according to claim 10, further comprising a damper that joins the rectangular reinforcing member or the reinforcing rectangular bobbin defining the rectangular space of the voice coil assembly to the magnetic circuits or the frame to vibratably support the voice coil assembly.

13. A loudspeaker comprising the voice coil assembly according to claim 9 including the plurality of conductive reinforcing members, magnetic circuits having magnetic gaps in which the rectangular coils of the voice coil assembly are arranged, a loudspeaker diaphragm bonded to the voice coil assembly, an edge vibratably supporting an outer peripheral end of the loudspeaker diaphragm, and a frame to which an outer peripheral end of the edge and the magnetic circuits are joined, wherein the magnetic circuits comprise a plurality of magnets capped by rectangular flat plates, and yokes bonded to the magnets, so that the rectangular magnetic gaps are formed between the plates and the yokes, and insertion grooves through which the rectangular reinforcing member of the voice coil assembly is arranged are provided at corner portions of the rectangular magnetic gaps, and the damper fixing portions of the conductive reinforcing members of the voice coil assembly are joined to the frame or the magnetic circuits.

14. The loudspeaker according to claim 13, further comprising a loudspeaker terminal provided in the frame, wherein the damper fixing portions of the conductive reinforcing members of the voice coil assembly are joined to the frame or the magnetic circuits to be conductively connected to the loudspeaker terminal through connection wires.

* * * * *